US011835036B2

(12) United States Patent
Chang et al.

(10) Patent No.: US 11,835,036 B2
(45) Date of Patent: Dec. 5, 2023

(54) PISTON FOR PUMP AND PUMP

(71) Applicant: XIAMEN KOGE MICRO TECH CO., LTD., Xiamen (CN)

(72) Inventors: Kunlin Chang, Xiamen (CN); Chunlian Wang, Xiamen (CN)

(73) Assignee: XIAMEN KOGE MICRO TECH CO., LTD., Xiamen (CN)

( * ) Notice: Subject to any disclaimer, the term of this patent is extended or adjusted under 35 U.S.C. 154(b) by 1069 days.

(21) Appl. No.: 16/330,704

(22) PCT Filed: Mar. 30, 2017

(86) PCT No.: PCT/CN2017/078883
§ 371 (c)(1),
(2) Date: Mar. 5, 2019

(87) PCT Pub. No.: WO2018/040556
PCT Pub. Date: Mar. 8, 2018

(65) Prior Publication Data

US 2021/0277881 A1 Sep. 9, 2021

(30) Foreign Application Priority Data

Sep. 5, 2016 (CN) ..... 201610801651.X

(51) Int. Cl.
*F04B 43/02* (2006.01)
*F04B 43/00* (2006.01)

(52) U.S. Cl.
CPC ..... *F04B 43/02* (2013.01); *F04B 43/0054* (2013.01); *F04B 43/0045* (2013.01)

(58) Field of Classification Search
CPC ..... F04B 43/02; F04B 53/22; F04B 43/025; F04B 43/0054; F04B 43/0045; F04B 43/0018; F04B 43/0009; F04B 43/00
USPC ..... 417/412, 413.1
See application file for complete search history.

(56) References Cited

U.S. PATENT DOCUMENTS 6,382,928 B1 * 5/2002 Chang ..... F04B 43/026 417/269
2005/0268416 A1 * 12/2005 Sommers ..... A47K 7/028 15/209.1
2012/0164010 A1 * 6/2012 Pascual ..... F04B 17/03 417/410.5
2017/0135532 A1 * 5/2017 Ciavarella ..... A47K 5/14

OTHER PUBLICATIONS

International Search Report issued in International Application No. PCT/CN2017/078883 dated May 19, 2017 (2 pages).
Written Opinion issued in International Application No. PCT/CN2017/078883 dated May 19, 2017 (3 pages).

* cited by examiner

*Primary Examiner* — Philip E Stimpert
(74) *Attorney, Agent, or Firm* — Osha Bergman Watanabe & Burton LLP

(57) ABSTRACT

A piston for a pump and a pump are provided. A piston bladder (2) of the piston is cylindrical in shape, a chamber (20) is a cylindrical chamber, the chamber (20) has as inner diameter of 9.2±0.5 mm, the chamber (20) has a depth of 3.8±0.5 mm, the piston bladder (2) has a wall with a thickness of 0.5±0.3 mm, and the piston bladder (2) has an outer circumferential surface, a part of the outer circumferential surface connected to a base plate (1) protrudes outwards radially to form a protective sleeve (21).

18 Claims, 2 Drawing Sheets

PISTON FOR PUMP AND PUMP

CROSS-REFERENCE TO RELATED APPLICATIONS

The present application is a national phase entry under 35 USC § 371 of international Application PCT/CN20171078883, filed Mar. 30, 2017, which claims the benefit of and priority to Chinese Patent Application No. 201610801651.X, filed Sep. 5, 2016, the entire disclosures of which are incorporated herein by reference.

FIELD

The present disclosure relates to the technical field of pump equipment, and more particularly to a piston for a pump and a pump.

BACKGROUND

Pumps, such as air pumps, water pumps and the like are used widely, and the pumps also can be used for driving other fluid to flow. A piston is the key part of the pumps. Some pistons in the pumps are also known as diaphragms. Setting of structure parameters of the piston is one of important factors influencing flow driven by the pumps.

A bladder construction including top edges, hollow cylindrical chambers, a pressing solid body and a bottom rod is disclosed in the related art. Each of the hollow cylindrical chambers is connected to one pressing solid body and a bottom rod. The top edges of the bladder are connected together. Parameters, such as chamfers, a thickness of a chamber wall of the hollow cylindrical chambers are also disclosed in the technical material. This bladder cannot is not suitable for a pump of which a housing with an internal diameter of D23-D29 mm.

SUMMARY

The present application is made based on discovery and cognition of the following facts and issues.

In the related art, structural parameters of a piston in a pump are improper, resulting low flow and short service life of the pump. When the inventor manufactures a pump of which a housing having an inner diameter of D23 to D29, no piston disclosed in the related materials enables the pump to have ideal performance. Therefore, the inventor optimized the structural parameters of the piston based on cognition of a pump construction and tests for heaps of times. That is, the present disclosure aims to provide a piston for a pump, and structural parameters of the piston are optimized, such that the pump has improved performance.

Another objective of the present disclosure is to provide a pump with the above piston.

The piston for a pump includes a base plate, a piston bladder, a solid body and a connecting rod. The piston bladder is arranged at a side of the base plate, the solid body is arranged at a side of the piston bladder away from the base plate, the connecting rod is arranged at a side of the solid body away from the base plate, the piston bladder defines a chamber therein, and the chamber has an opening at a side facing the base plate. The piston bladder is cylindrical in shape, the chamber is a cylindrical chamber, the chamber has as inner diameter of 9.2±0.5 mm, the chamber has a depth of 3.8±0.5 mm, the piston bladder has a wall with a thickness of 0.5±0.3 mm, and the piston bladder has an outer circumferential surface, a part of the outer circumferential surface connected to the base plate protrudes outwards radially to form a protective sleeve.

With optimized structural parameters, the piston according to the embodiment of the present disclosure can achieve stable water yield with low power consumption, thereby enable a pump to have a long service life, some pump can have a service life up to 1000 hours.

Specifically, an edge of the opening of the chamber is chamfered.

In some embodiments, a plurality of piston bladders are provided, and the plurality of piston bladder are all arranged at a side of the base plate, one solid body is arranged at a side of each piston bladder away from the base plate, and one connecting rod is arranged at a side of the solid body away from the base plate. In this way, the plurality of piston bladders are connected together by means of the base plate, thereby simplifying structure and facilitating assembling and disassembling. Parallel connection of the plurality of piston bladder is achieved, which makes driving easier.

Specifically, the plurality of piston bladders are round in shape and arranged about a central axis of the base plate. In this way, the plurality of piston bladders are arranged in a compact manner, reducing a size of the piston.

Optionally, the base plate defines a through central hole in a central part thereof.

Furthermore, the base plate is round, an edge of the base plate defines a plurality of notches spaced apart, and each notch is located between two adjacent piston bladders.

Optionally, a part of the base plate between the two adjacent piston bladders defines a through side hole.

Optionally, an outer edge is formed between two adjacent notches of the base plate, each outer edge is provided with a protrusion block 15 at a bottom thereof.

In some embodiments, a part of an outer circumferential wall of the connecting rod protrudes out to form a block. The block is arranged to facilitate connection between a power element and the piston.

The pump according to embodiments of the present disclosure includes the piston for a pump according to the above embodiments of the present disclosure.

With optimized structural parameters, the pump according to the embodiment of the present disclosure can achieve stable water yield with low power consumption, thereby enable the pump to have a long service life, some pump can have a service life up to 1000 hours.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other additional aspects and advantages of embodiments of the present disclosure will become apparent and more readily appreciated from the following descriptions made with reference to the drawings, in which.

Figure 1:
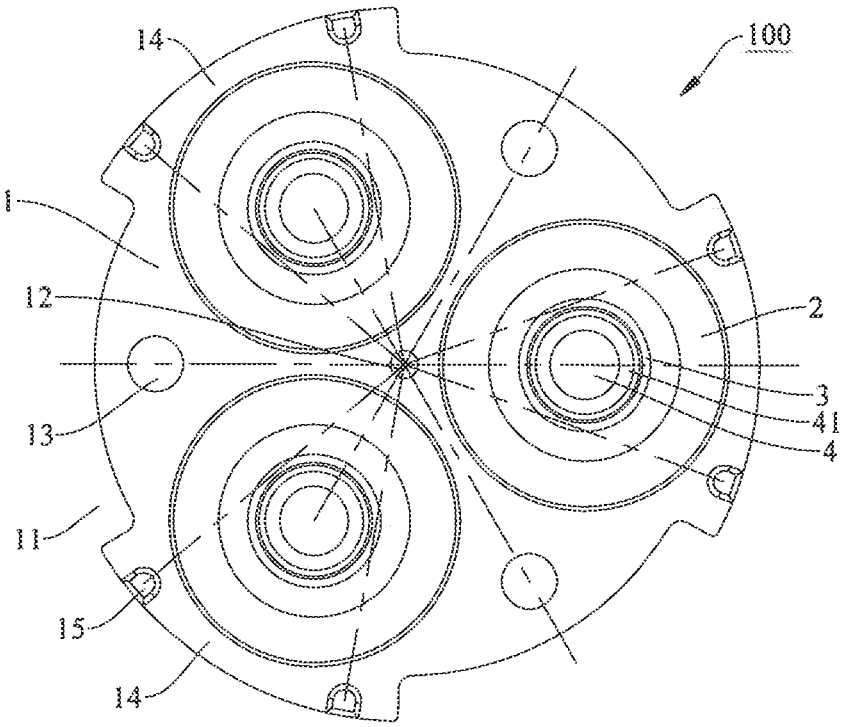
FIG. 1 is a bottom view of a piston according to an embodiment of the present disclosure.

REFERENCE NUMERALS piston 100,
base plate 1, notch 11, central hole 12, side hole 13, outer edge 14, protrusion 15, connecting ring 16,
piston bladder 2, the chamber 20, protective sleeve 21,
solid body 3,
connecting rod 4, block 41.

DETAILED DESCRIPTION

Reference will be made in detail to embodiments of the present disclosure, and examples of the embodiments are illustrated in the drawings. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

A piston 100 for a pump according to embodiments of the present disclosure is described with reference to FIG. 1 to FIG. 3.

Figure 2:
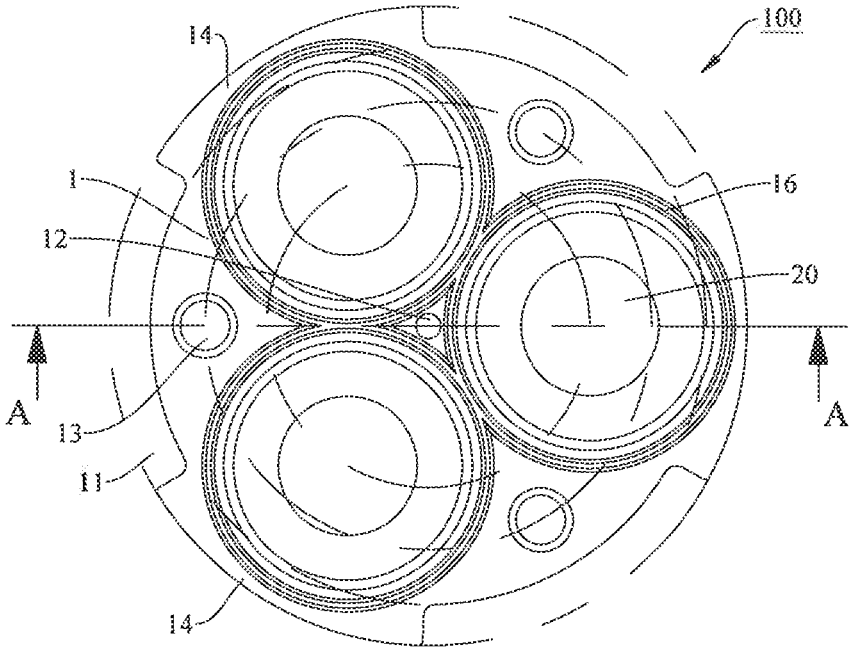
FIG. 2 is a top view of a piston according to an embodiment of the present disclosure.
Figure 3:
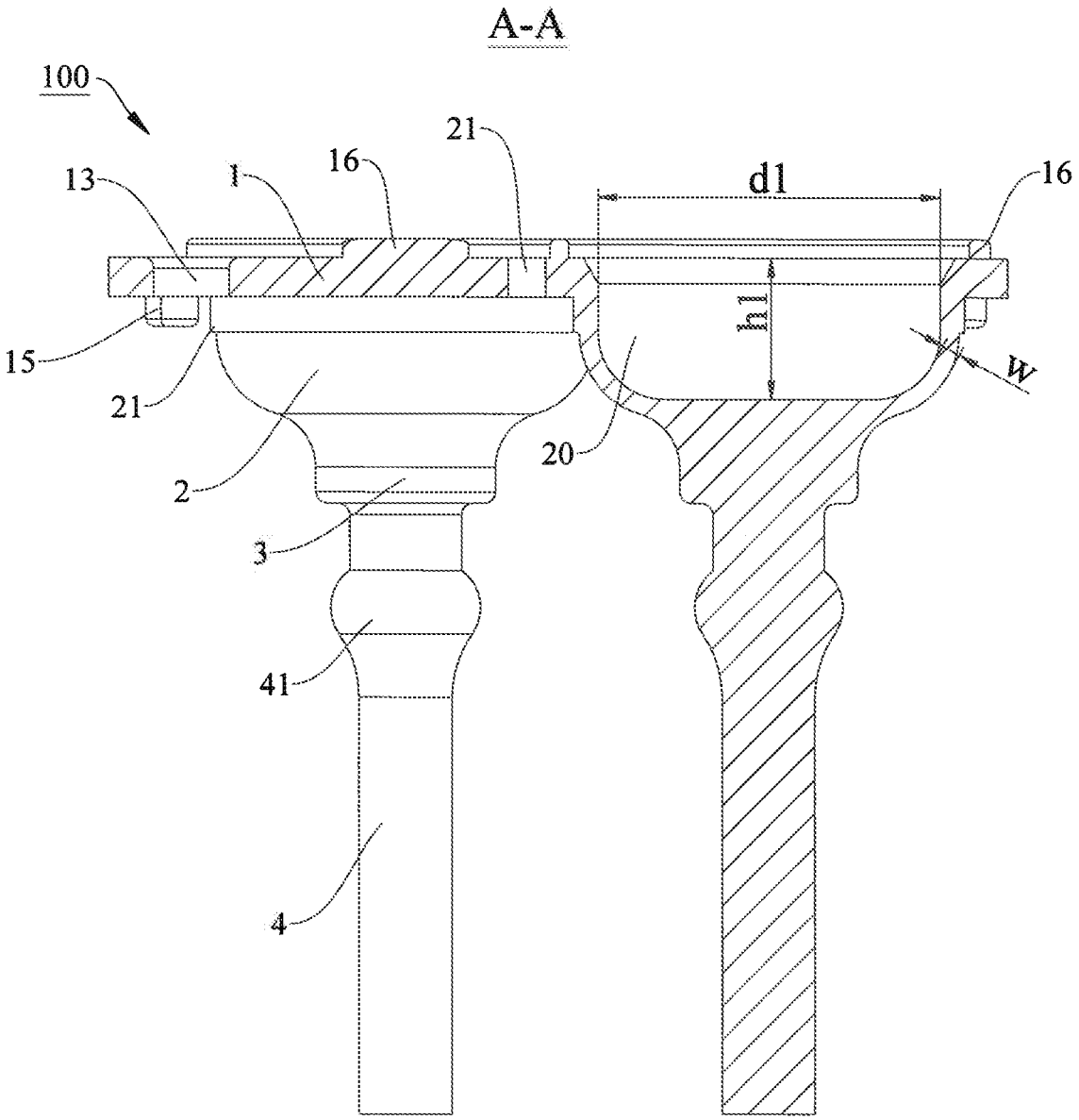
FIG. 3 is a sectional view taken along line A-A in FIG. 2.

As shown in FIG. 1 to FIG. 3, the piston 100 for a pump according to embodiments of the present disclosure includes a base plate 1, a piston bladder 2, a solid body 3 and a connecting rod 4. The piston bladder 2 is arranged at a side of the base plate 1, the solid body 3 is arranged at a side of the piston bladder 2 away from the base plate 1. The connecting rod 4 is arranged at a side of the solid body 3 away from the base plate 1. The piston bladder 2 defines a chamber 20 therein, and the chamber 20 has an opening at a side facing the base plate 1.

When the piston 100 operates, a power element drives the connecting rod 4 of the piston 100 to reciprocate, the connecting rod 4 of the piston 100 pulls the solid body 3 to reciprocate, the solid body 3 presses the piston bladder 2, thereby changing a volume of the chamber 20 in the piston bladder 2. Suction is achieved when the volume of the chamber 20 increases, and extrusion is achieved when the volume of the chamber 20 decreases. Therefore, a pump can reciprocally suck and extrude a liquid by means of reciprocation of the connecting rod 4, such that the pump can drive the liquid to flow towards a special direction continuously.

When the piston 100 is employed by a special pump of which a housing with an internal diameter of D23-D29 mm, as shown in FIG. 3, the piston 100 in this pump should has structural parameters meeting the following requirements.

The piston bladder 2 is cylindrical in shape, the chamber 20 is a cylindrical chamber, the chamber 20 has as inner diameter d1 of 9.2±0.5 mm, the chamber 20 has a depth h1 of 3.8±0.5 mm, and the piston bladder 2 has a wall with a thickness w of 0.5±0.3 mm.

The piston bladder 2 has a outer circumferential surface, a part of the outer circumferential surface is connected to the base plate 1, and the part protrudes outwards radially to form a protective sleeve 21. The solid body 3 is cylindrical in shape.

The piston 100 with the above optimized structural parameters can enable the pump to have stable load flow with low power consumption and stable water yield and have a long service life. As for a pump of which a housing with an internal diameter of D26 mm, the piston 100 has the above optimized structural parameters, that is the piston bladder 2 is cylindrical in shape, the chamber 20 is a cylindrical chamber, the chamber 20 has as inner diameter d1 of 9.2±0.5 mm, the chamber 20 has a depth h1 of 3.8±0.5 mm, and the piston bladder 2 has a wall with a thickness w of 0.5±0.3 mm, and the pump has a service life up to 1000 hours.

For better understanding that with the piston 100 having the optimized structural parameters according to the embodiments of the present disclosure, the performance of the pump (having a housing with an internal diameter of D23-D29 mm) can be improved, the inventor carried out a test in which the piston 100 having the structural parameters according to the embodiments of the present disclosure is arranged in a pump, and another test in which another piston having structural parameters without optimization is arranged in another pump with the same structure. The inventor compared parameters of test results after the two pump tests, in which the pumps having housings with inner diameters of 23-29 mm, except the piston 100, parameters and structures of other components of the pumps are identical in the tests.

TABLE 1

Comparison table of results of tests in which the pumps having pistons with different structural parameters

| | Current Pump: Flow of product before technical improvement Load 3.5 psi | | Current Pump: Flow of product with the piston of the present embodiments of the present disclosure Load 3.5 psi | |
|---|---|---|---|---|
| Test number | <180 mA Current (DC 9.3 V, suction stroke of water pump: 0.1 m, load 3.5 psi) | reference range (230 g ± 15 g) Water Yield (DC 9.3 V, suction stroke of water pump: 0.1 m, load 3.5 psi, time 31 s) | <180 mA Current (DC 9.3 V, suction stroke of water pump: 0.1 m, load 3.5 psi) | reference range (230 g ± 15 g) Water Yield (DC 9.3 V, suction stroke of water pump: 0.1 m, load 3.5 psi, time 31 s) |
| 1# | 273 | 260.0 | 95 | 233.9 |
| 2# | 285 | 233.5 | 93 | 229.8 |
| 3# | 279 | 248.6 | 95 | 226.4 |
| 4# | 291 | 238.8 | 94 | 226.8 |
| 5# | 270 | 229.3 | 93 | 229.0 |
| 6# | 269 | 241.6 | 93 | 229.1 |
| 7# | 288 | 235.5 | 92 | 230.3 |
| 8# | 294 | 248.3 | 92 | 229.6 |
| 9# | 289 | 253.4 | 92 | 230.1 |
| 10# | 291 | 243.4 | 93 | 230.1 |

The ten groups of data in table 1 show comparison of currents and water yields according to results of tests in which two pumps are under the same conditions (DC9.3V, suction stroke of water pump: 0.1 m, load 3.5 psi, time 31 s).

The result of the comparison based on the groups of data statistics proves that, the pump with the piston according to the embodiments of the present disclosure has stable water yield with low power consumption under the same operation conditions. The result of the comparison based on the groups of data statistics also proves that the above conclusion is an objective result after verification.

A structure of the piston 100 in a specific embodiment according to the present disclosure is described with reference to FIG. 1 to FIG. 3.

In the embodiment, a plurality of piston bladders 2 are provided, and the plurality of piston bladder 2 are all arranged at a side of the base plate 1, one solid body 3 is arranged at a side of each piston bladder 2 away from the base plate 1, and one connecting rod 4 is arranged at a side of the solid body 3 away from the base plate 1. In this way, the plurality of piston bladders 2 are connected together by means of the base plate 1, thereby simplifying structure and facilitating assembling and disassembling. Parallel connection of the plurality of piston bladder 2 is achieved, which makes driving easier.

Specifically, three piston bladders 2 are provided, accordingly the pistons 100 is provided with three solid bodies 3 and three connecting rods 4.

Specifically, the plurality of piston bladders 2 are round in shape and arranged about a central axis of the base plate 1. In this way, the plurality of piston bladders 2 are arranged in a compact manner, reducing a size of the piston 100.

The base plate 1 is a round plate, the base plate 1 defines a central hole 12 in a central part thereof, and the central hole 12 runs through the base plate 1 in a thickness direction thereof and is a round hole which is concentric with the base plate 1.

In the embodiment, an edge of the base plate 1 defines a plurality of notches 11 spaced apart, each notch 11 runs through the base plate 1 in the thickness direction thereof, and each notch 11 opens towards a periphery direction of the base plate 1.

Each notch 11 is located between two adjacent piston bladders 2, a part of the base plate 1 between the two adjacent piston bladders 2, defines a through side hole 13, and the side hole 13 has an end away from the connecting rod 4 chamfered.

Specifically, the side hole 13 is arranged in a central line of a corresponding notch 11.

Specifically, as shown in FIG. 3, an edge of the opening of the chamber 20 is chamfered, such that the piston 100 is easy to demould during machining, and a valve disc in the pump can cooperate with the piston conveniently. Furthermore, an arc surface connects a bottom wall with a circumferential wall of the chamber 20.

A side of the base plate 1 away from the connecting rod 4 is provided with a connecting ring 16 around the opening of the chamber 20, and the connecting ring 16 is an annular ring. It can be seen from FIG. 2, connecting rings 16 of a plurality of the chambers 20 join together at connections.

Optionally, an outer edge 14 is formed between two adjacent notches 11 of the base plate, each outer edge 14 is provided with a protrusion block 15 at a bottom thereof, that is a side of each outer edge 14 towards the connecting rod 4 is provided with the protrusion block 15. The protrusion block 15 is arranged for cooperative connection with other components of the piston 100.

Specifically, each outer edge 14 is provided with two protrusion blocks 15, and the two protrusion blocks 15 are arranged at two sides of the outer edge 14 in a circumferential direction.

In the embodiment, a part of an outer circumferential wall of the connecting rod 4 protrudes out to form a block 41. The block 41 is arranged to facilitate connection between a power element and the piston 100, e. g., the power element can be prevent from falling off from the piston 100 through being locked between the block 41 and the solid body 3.

An outer circumferential surface of the block 41 is an arc surface, thereby reducing abrasion.

To sum up, with the piston 100 according to the embodiment of the present disclosure, the piston bladder 2 is easier to deform and extrude, thereby preventing abrasion and prolonging a service life of a product.

The pump according to the embodiment of the present disclosure includes the piston 100 according to the embodiment of the present disclosure. Therefore, by employing the piston 100 with the optimized parameters of the present disclosure, the pump according to the embodiment of the present disclosure is stable in water yield with low power consumption, and the pump has a long service life, some pump can have a service life up to 1000 hours.

In the specification, it is to be understood that terms such as "length," "width," "thickness," "upper," "lower," "vertical," "horizontal," "top," "bottom," "inner," "outer," "radial," and "circumferential" should be construed to refer to the orientation as then described or as shown in the drawings under discussion. These relative terms are for convenience of description and do not require that the present disclosure be constructed or operated in a particular orientation, which cannot be construed as limit to the present disclosure therefore.

In the specification, unless specified or limited otherwise, relative terms such as "central", "longitudinal", "lateral", "front", "rear", "right", "left", "inner", "outer", "lower", "upper", "horizontal", "vertical", "above", "below", "up", "top", "bottom" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation.

In the present disclosure, unless specified or limited otherwise, the terms "connected," should be understood broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

Reference throughout this specification to "an embodiment," "an example," and the like means that a particular feature, structure, material, or characteristic described in connection with the embodiment or example is included in at least one embodiment or example of the present disclosure. Thus, the appearances of the phrases throughout this specification are not necessarily referring to the same embodiment or example. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A piston for a pump, comprising a base plate, a plurality of piston bladders, a corresponding plurality of solid bodies and a corresponding plurality of connecting rods, each of the piston bladders being arranged at a side of the base plate, each of the solid bodies being arranged at a side of the corresponding piston bladder away from the base plate, each of the connecting rods being arranged at a side of the corresponding solid body away from the base plate, each of the piston bladders defining a chamber therein, and the chamber having an opening at a side facing the base plate, wherein each of the piston bladders is cylindrical in shape, the chamber is a cylindrical chamber, the chamber has as inner diameter of 9.2±0.5 mm, the chamber has a depth of 3.8±0.5 mm, each of the piston bladders has a wall with a thickness of 0.5±0.3 mm, each of the piston bladders has an outer circumferential surface, and a part of the outer circumferential surface connected to the base plate protrudes outwards radially to form a protective sleeve;

a connecting ring is arranged around the opening of the chamber of each of the piston bladders;

the plurality of piston bladders are all arranged at the side of the base plate, and connecting rings around respective chambers of the plurality of piston bladders are transitioned to each other and directly joined together at connections;

the base plate comprises a plurality of radially recessed notches spaced apart along an edge of the base plate; and a plurality of through side holes, each through side hole being on a central line of a corresponding notch and being between a center of the base plate and the corresponding notch, and the central line being perpendicular to an axial direction of the base plate; and each notch runs through the base plate from an upper surface of the base plate in a thickness direction of the base plate, and the connecting rings are on the upper surface.

2. The piston according to claim 1, wherein an edge of the opening of the chamber is chamfered.

3. The piston according to claim 2, wherein one solid body is arranged at a side of each piston bladder away from the base plate, and one connecting rod is arranged at a side of the solid body away from the base plate.

4. The piston according to claim 3, wherein the plurality of piston bladders are round in shape and arranged about a central axis of the base plate.

5. The piston according to claim 4, wherein the base plate defines a through central hole in a central part thereof.

6. The piston according to claim 5, wherein the base plate is round, and each notch is located between two adjacent piston bladders.

7. The piston according to claim 6, wherein an outer edge is formed between two adjacent notches of the base plate, each outer edge is provided with a protrusion block at a bottom thereof.

8. The piston according to claim 2, wherein a part of an outer circumferential wall of each of the connecting rods protrudes out to form a block.

9. The piston according to claim 1, wherein one solid body is arranged at a side of each piston bladder away from the base plate, and one connecting rod is arranged at a side of the solid body away from the base plate.

10. The piston according to claim 9, wherein the plurality of piston bladders are round in shape and arranged about a central axis of the base plate.

11. The piston according to claim 10, wherein the base plate defines a through central hole in a central part thereof.

12. The piston according to claim 11, wherein the base plate is round, and each notch is located between two adjacent piston bladders.

13. The piston according to claim 12, wherein an outer edge is formed between two adjacent notches of the base plate, each outer edge is provided with a protrusion block at a bottom thereof.

14. The piston according to claim 11, wherein a part of an outer circumferential wall of each of the connecting rods protrudes out to form a block.

15. The piston according to claim 10, wherein a part of an outer circumferential wall of each of the connecting rods protrudes out to form a block.

16. The piston according to claim 9, wherein a part of an outer circumferential wall of each of the connecting rods protrudes out to form a block.

17. The piston according to claim 1, wherein a part of an outer circumferential wall of each of the connecting rods protrudes out to form a block.

18. A pump comprising a piston, the piston comprising a base plate, a plurality of piston bladders, a corresponding plurality of solid bodies and a corresponding plurality of connecting rods, each of the piston bladders being arranged at a side of the base plate, each of the solid bodies being arranged at a side of the corresponding piston bladder away from the base plate, each of the connecting rods being arranged at a side of the corresponding solid body away from the base plate, each of the piston bladders defining a chamber therein, and the chamber having an opening at a side facing the base plate, wherein each of the piston bladders is cylindrical in shape, the chamber is a cylindrical chamber, the chamber has as inner diameter of 9.2±0.5 mm, the chamber has a depth of 3.8±0.5 mm, each of the piston bladders has a wall with a thickness of 0.5±0.3 mm, each of the piston bladders has an outer circumferential surface, and a part of the outer circumferential surface connected to the base plate protrudes outwards radially to form a protective sleeve;

a connecting ring is arranged around the opening of the chamber of each of the piston bladders;

the plurality of piston bladders are all arranged at the side of the base plate, and connecting rings around respective chambers of the plurality of piston bladders are transitioned to each other and directly joined together at connections;

the base plate comprises a plurality of radially recessed notches spaced apart along an edge of the base plate; and a plurality of through side holes, each through side hole being on a central line of a corresponding notch and being between a center of the base plate and the corresponding notch, and the central line being perpendicular to an axial direction of the base plate; and each notch runs through the base plate from an upper surface of the base plate in a thickness direction of the base plate, and the connecting rings are on the upper surface.

* * * * *